US006503101B1

(12) United States Patent
Yu

(10) Patent No.: US 6,503,101 B1
(45) Date of Patent: Jan. 7, 2003

(54) ELECTRICAL CONNECTOR HAVING GROUNDING PATH

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/007,070

(22) Filed: Dec. 4, 2001

(51) Int. Cl.[7] ..... H01R 13/648; H01R 4/66
(52) U.S. Cl. ..... 439/607; 439/108
(58) Field of Search ..... 439/607, 108, 439/188, 189

(56) References Cited

U.S. PATENT DOCUMENTS 5,915,976 A * 6/1999 McHugh
6,042,396 A * 3/2000 Wu et al.
6,159,021 A * 12/2000 Kusuhara
6,250,935 B1 * 6/2001 Mochizuki et al.
2001/0039140 A1 * 11/2001 Fasold et al.

* cited by examiner

*Primary Examiner*—Brian Sircus
*Assistant Examiner*—Chandrika Prasad
(74) *Attorney, Agent, or Firm*—Wei Te Chung

(57) ABSTRACT

An electrical connector (1) includes a plug (10) and a receptacle (20) coupled with the plug. The plug includes a housing (11), a plurality of terminals (16) received in the housing, and two shielding plates (14) attached to opposite sidewalls (114) of the housing. A plurality of apertures (116) is defined in the sidewalls. The receptacle includes a housing (21) and a plurality of terminals (24) received in the housing. A plurality of holes (212) is defined in opposite sidewalls (28) of the receptacle respectively. When the plug and receptacle are coupled, the terminals of the plug actuate the terminals of the receptacle to extend through the holes of the receptacle and the apertures of the plug and to electrically contact the shielding plates.

20 Claims, 5 Drawing Sheets

1

ELECTRICAL CONNECTOR HAVING GROUNDING PATH

BACKGROUND OF THE INVENTION

1. Field of the Invention

The present invention relates to electrical connectors, and particularly to an electrical connector having a simple grounding path.

2. Prior Art

A conventional electrical connector normally forms a metal shielding surrounding a dielectric housing thereof. The shielding is grounded to prevent electromagnetic interference during signal transmitting, thereby assuring stable signal transmitting. However, the surrounding shielding complicates the structure of the electrical connector and therefore increases costs of the electrical connector.

FIG. 5 shows a conventional electrical connector 2 for overcoming the above problems. The electrical connector 2 includes a plug 3 and a receptacle 7 coupling to the plug 3. The plug 3 includes a dielectric plug housing 4 having a shielding plate 5 at each side thereof, and a plurality of plug grounding terminals 6 received in the housing 4 and electrically connecting the shielding plates 5. When the plug 3 mates with the receptacle 7, the shielding plates 5 electrically connect receptacle grounding terminals 8 of the receptacle 7 and thereby ground the connector 2.

However, grounding of the connector 2 by the shielding plates 5 electrically connecting the plug and receptacle grounding terminals 6, 8 is still unduly complicated. Furthermore, the shielding plates 5 are easily displaced or even fall off during interconnection between the plug 3 and the receptacle 7.

SUMMARY OF THE INVENTION

Accordingly, an object of the present invention is to provide an electrical connector having simple construction grounding paths that provide improved grounding.

To achieve the above-mentioned object, an electrical connector in accordance with the present invention includes a plug and a receptacle coupled with the plug. The plug includes a housing, a plurality of terminals received in the housing, and two shielding plates attached to opposite sidewalls of the housing. A plurality of apertures is defined in the sidewalls. The receptacle includes a housing and a plurality of terminals received in the housing. A plurality of holes is defined in opposite sidewalls of the receptacle. When the plug and receptacle are coupled, the terminals of the plug actuate the terminals of the receptacle to extend through the holes of the receptacle and the apertures of the plug and electrically contact the shielding plates.

Other objects, advantages and novel features of the present invention will be drawn from the following detailed description of a preferred embodiment of the present invention with attached drawings, in which:

DETAILED DESCRIPTION OF THE PREFERRED EMBODIMENT

Figure 1:
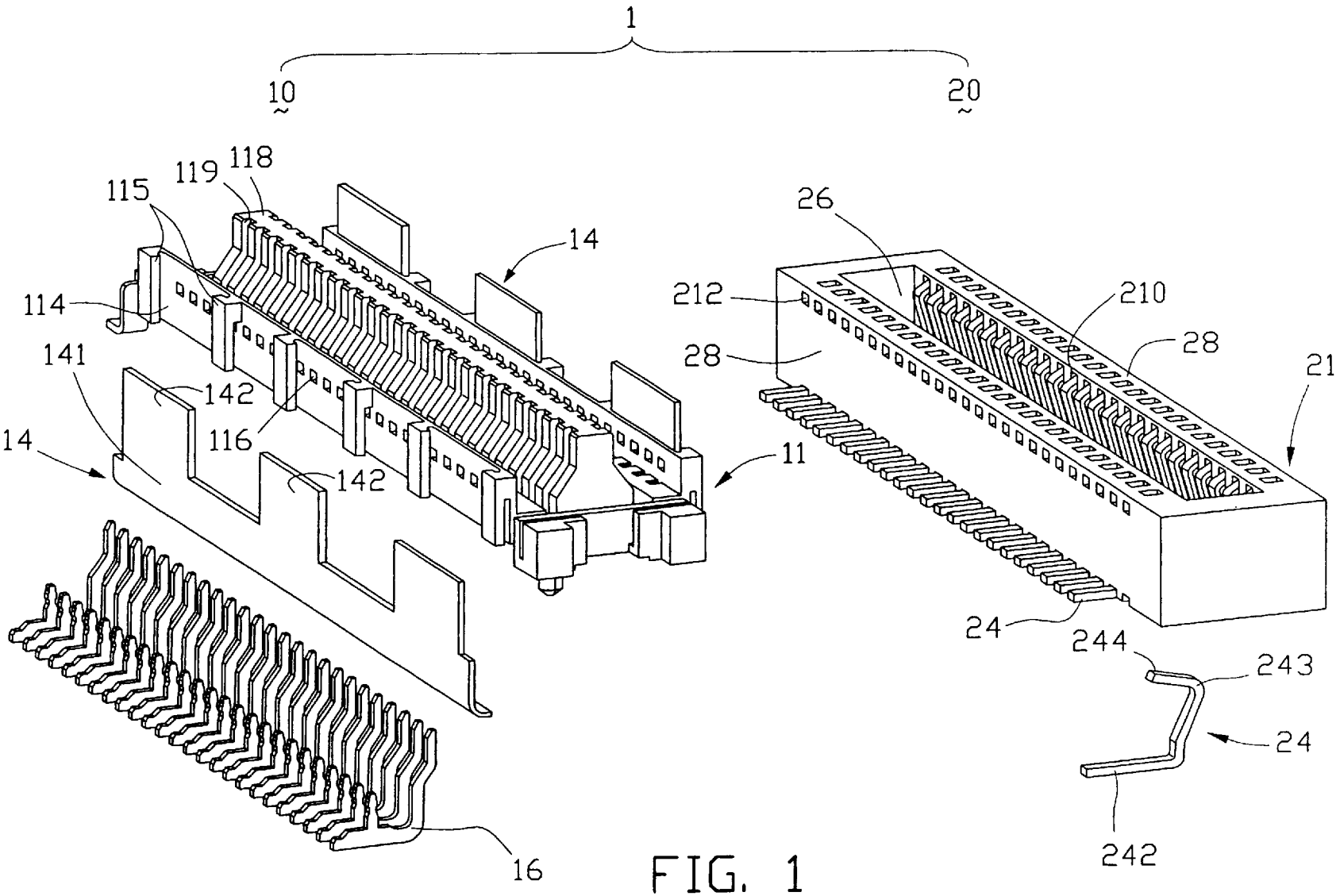
FIG. 1 is an exploded view of an electrical connector in accordance with the present invention.
Figure 2:
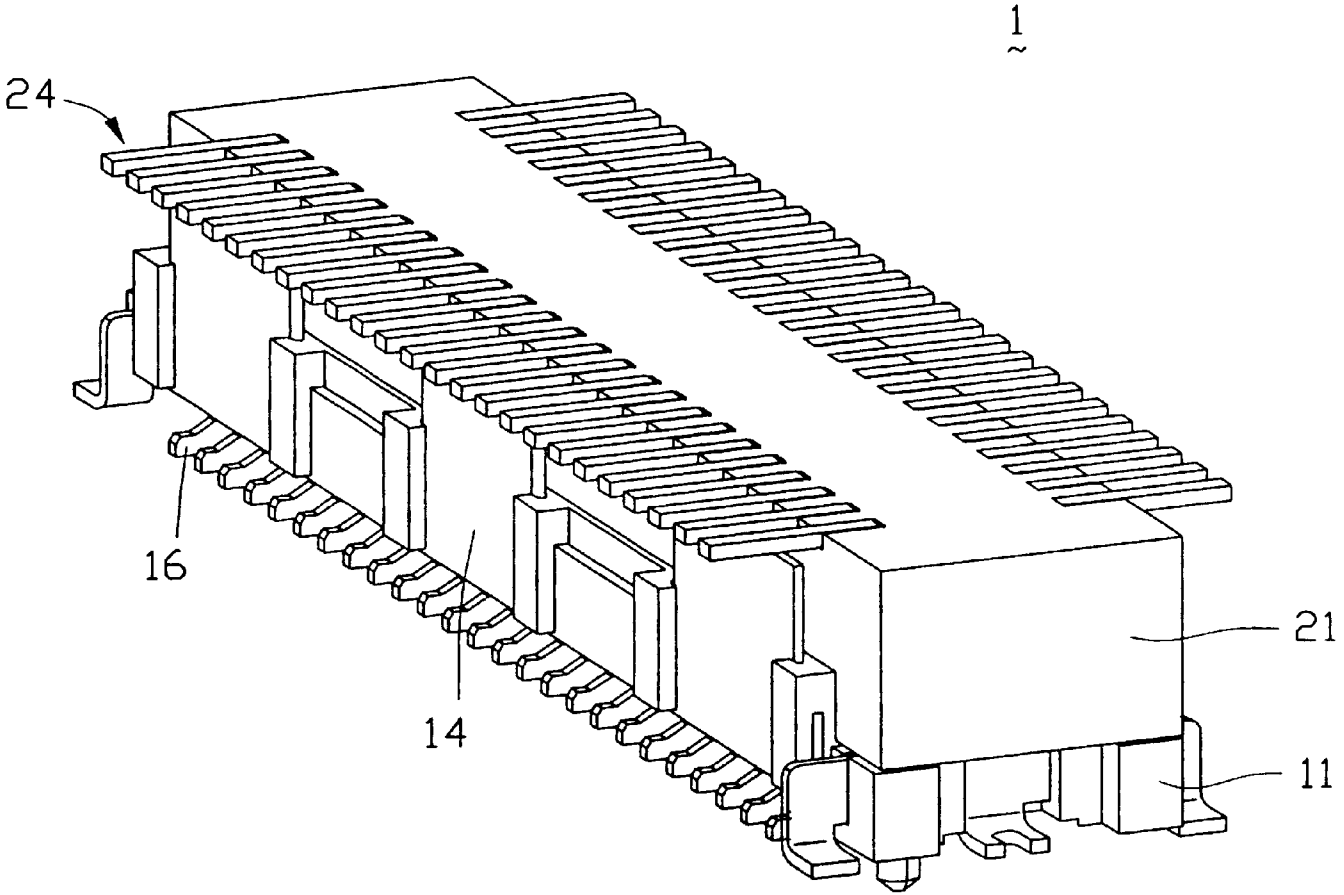
FIG. 2 is an assembled view of FIG. 1.

Referring to FIGS. 1 and 2, an electrical connector 1 in accordance with the present invention includes a plug 10 and a receptacle 20 coupled with the plug 10. The plug 10 includes an insulative plug housing 11, two shielding plates 14 attached to opposite sides of the plug housing 11, and a plurality of plug terminals 16 received in the plug housing 11. The plug housing 11 includes two elongate plug sidewalls 114, and an insertion portion 118 between the plug sidewalls 114. Each plug sidewall 114 forms three pairs of outer retention blocks 115, and defines a plurality of apertures 116 therein. A plurality of spaced receiving grooves 119 is defined in both sides of the insertion portion 118 respectively, for receiving the plug terminals 16. Each shielding plate 14 includes a base portion 141 and three retention portions 142 extending in the same direction coplanarly from the base portion 141. The base portion 141 is secured between the corresponding retention blocks 115 and plug sidewall 114. Each retention portion 142 is secured between the corresponding pair of retention blocks 115, and projects from the corresponding plug sidewall 114.

The receptacle 20 includes an insulative receptacle housing 21, and a plurality of receptacle terminals 24 received in the receptacle housing 21. An elongate slot 26 is defined in the receptacle housing 21, and two opposite receptacle sidewalls 28 are thus formed. Each receptacle sidewall 28 defines a plurality of cavities 210 for receiving the receptacle terminals 24, and a plurality of holes 212 in communication with the cavities 210. Each receptacle terminal 24 includes a mounting portion 242, a mating portion 243 extending from the mounting portion 242, and an end portion 244 extending from the mating portion 243. The mounting portion 242 and end portion 244 are thus joined by the mating portion 243. In assembly, the end portion 244 of each receptacle terminal 24 is received in the cavity 210 of the receptacle housing 21. The end portion 244 is disposed opposite to and aligned with the corresponding hole 212 of the receptacle housing 21, so that the end portion 244 is extendable through the corresponding hole 212 (see FIG. 3).

Figure 3:
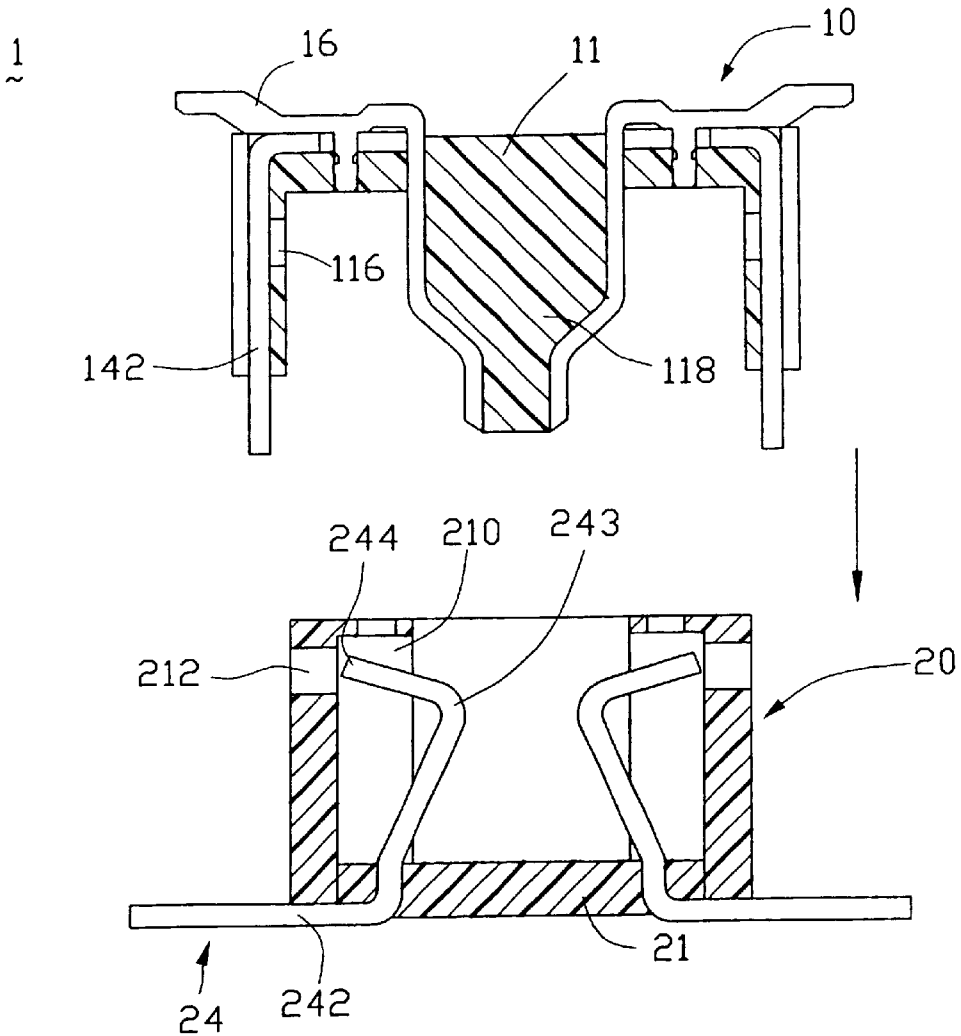
FIG. 3 is a cross-sectional view of a plug and a receptacle of the connector of FIG. 1, showing the plug ready to be mated with the receptacle.
Figure 4:
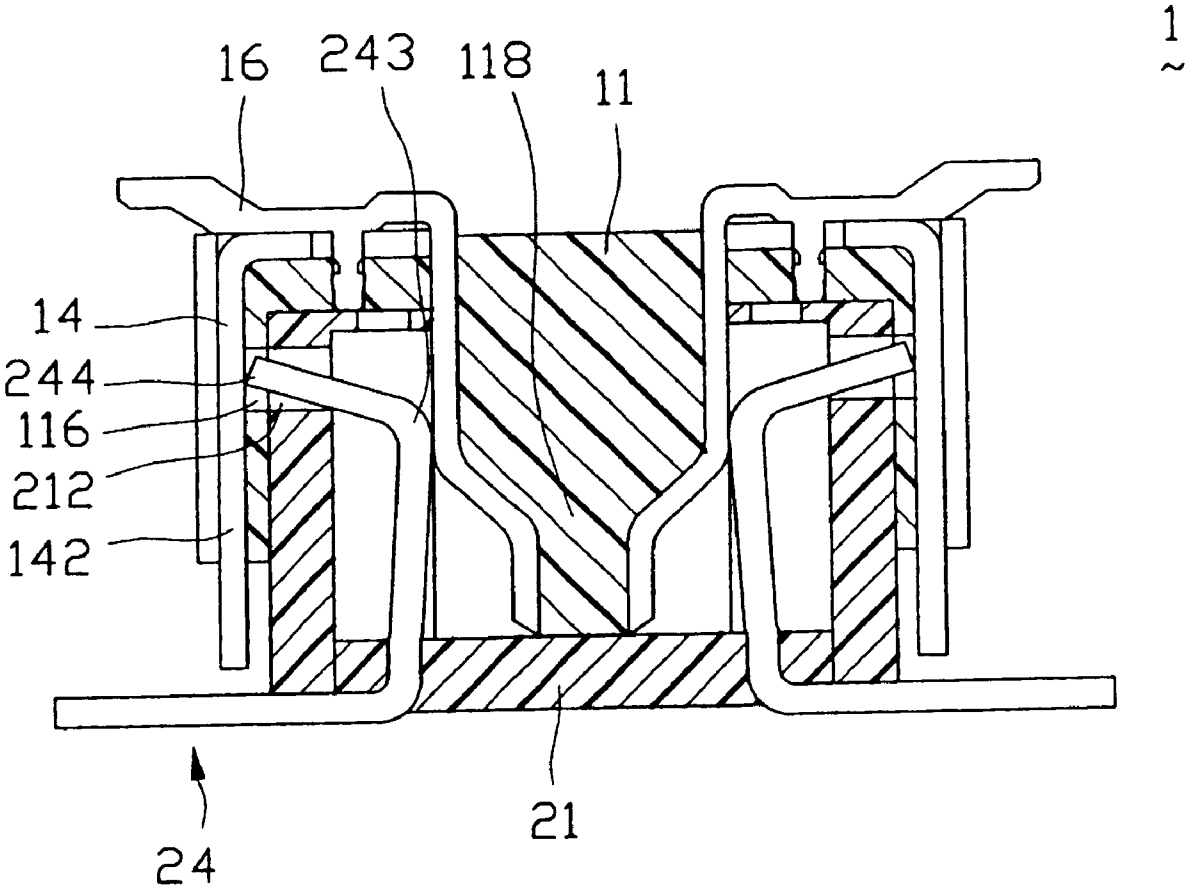
FIG. 4 is similar to FIG. 3, but showing the plug mated with the receptacle.
Figure 5:
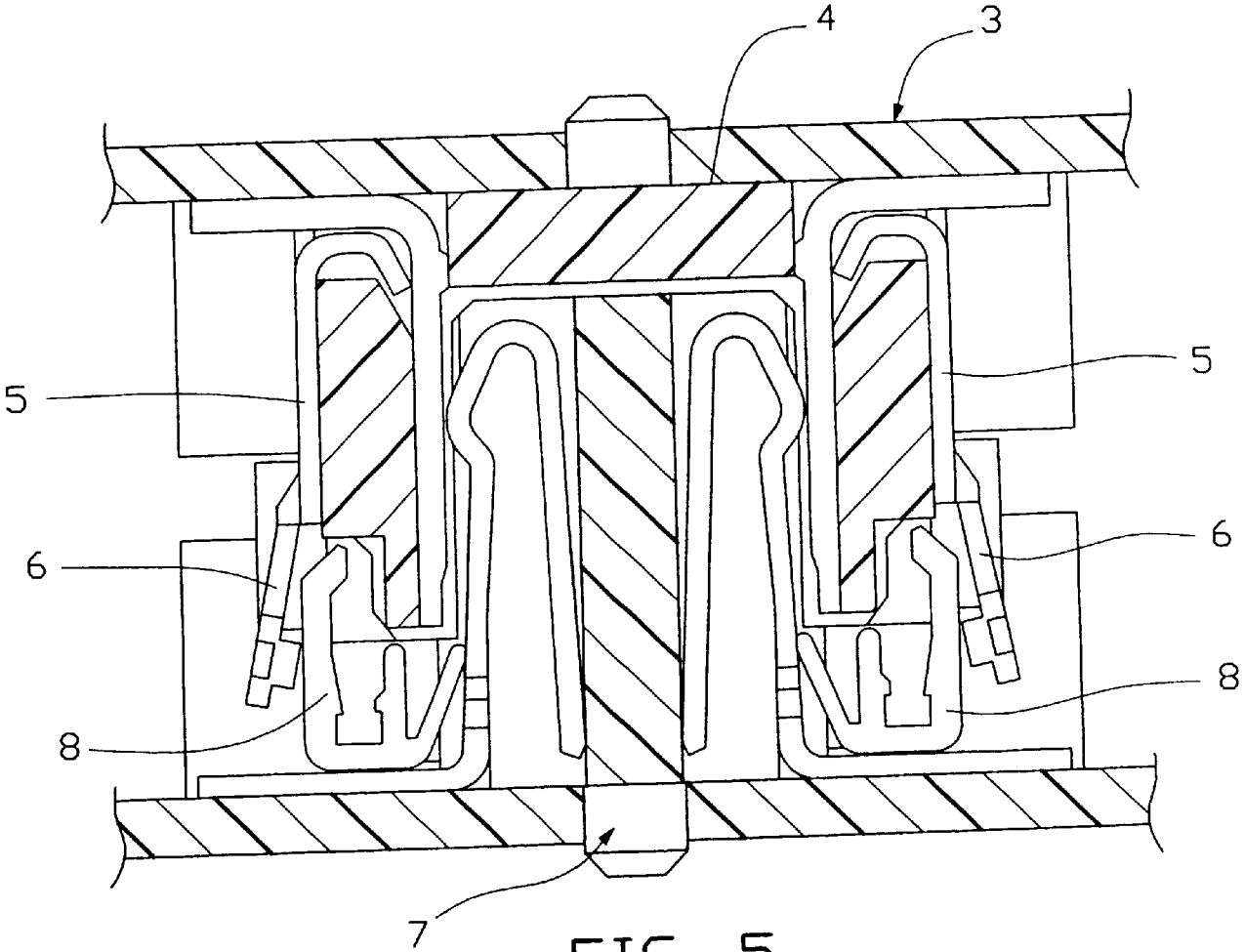
FIG. 5 (PRIOR ART)
FIG. 5 is a cross-sectional view of a conventional electrical connector.

FIGS. 3 and 4 show the plug 10 mating with the receptacle 20. The insertion portion 118 of the plug 10 is inserted into the slot 26 of the receptacle 20. The plug terminals 16 contact and then mate with the mating portions 243 of the receptacle terminals 24. During such mating, the plug terminals 16 actuate the mating portions 243 of the receptacle terminals 24 to rotate about the corresponding mounting portions 242. Thus the end portions 244 of the receptacle terminals 24 extend through the holes 212 of the receptacle sidewalls 28 and the apertures 116 of the plug sidewalls 114 and electrically contact with the shielding plates 14. When the mounting portions 242 of the receptacle terminals 24 are grounded, the shielding plates 14 and the corresponding plug terminals 16 are grounded. Therefore, simple grounding paths are formed among the plug terminals 16, the shielding plates 14 and the receptacle terminals 24.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. An electrical connector comprising:

a plug comprising a housing, a plurality of terminals received in the housing, and two shielding plates attached to opposite sidewalls of the housing, a plurality of apertures being defined in the sidewalls; and a receptacle coupling with the plug, the receptacle comprising a housing and a plurality of terminals received in the housing, a plurality of holes being defined in opposite sidewalls of the housing respectively, wherein when the plug and receptacle are coupled, the terminals of the plug actuate the terminals of the receptacle to extend through the holes of the receptacle and the apertures of the plug to electrically contact the shielding plates.

2. The electrical connector as claimed in claim 1, wherein each of the sidewalls of the plug forms a plurality of retention blocks for securing the shielding plate.

3. The electrical connector as claimed in claim 2, wherein each of the shielding plates comprises a base portion secured between two corresponding retention blocks and a corresponding sidewall of the plug, and a plurality of retention portions extending from the base portion and respectively secured between two corresponding retention blocks.

4. The electrical connector as claimed in claim 1, wherein the housing of the plug includes an insertion portion formed between the sidewalls of the plug, and a plurality of grooves is defined in the insertion portion for receiving the plug terminals.

5. The electrical connector as claimed in claim 4, wherein a slot is defined between the sidewalls of the receptacle for receiving the insertion portion of the plug.

6. The electrical connector as claimed in claim 1, wherein each of the receptacle terminals comprises a mounting portion, a mating portion extending from the mating portion, and an end portion extending from the mating portion and electrically contacting with a corresponding shielding plate when the plug is coupled with the receptacle.

7. The electrical connector as claimed in claim 1, wherein each of the sidewalls of the receptacle defines a plurality of cavities in communication with corresponding holes for receiving the terminals of the receptacle.

8. An electrical connector comprising:

a plug comprising a housing, at least one terminal received in the housing, and at least one shielding plate attached to one sidewall of the housing, at least one aperture being defined in the sidewall; and a receptacle coupling with the plug, the receptacle comprising a housing and at least one terminal received in the housing, at least one hole being defined in one sidewall of the housing, wherein when the plug and receptacle are coupled, the at least one terminal of the plug actuates the at least one terminal of the receptacle to extend through the at least one hole of the receptacle and the at least one aperture of the plug and electrically contact the at least one shielding plate.

9. The electrical connector as claimed in claim 8, wherein the sidewall of the plug forms at least two retention blocks for securing the at least one shielding plate.

10. The electrical connector as claimed in claim 9, wherein the at least one shielding plate comprises a base portion secured between two corresponding retention blocks and the sidewall of the plug, and at least one retention portion extending from the base portion and secured between two corresponding retention blocks.

11. The electrical connector as claimed in claim 8, wherein the plug forms an insertion portion, and defines at least one groove for receiving the at least one terminal of the plug.

12. The electrical connector as claimed in claim 11, wherein a slot is defined in the receptacle for receiving the insertion portion of the plug.

13. The electrical connector as claimed in claim 8, wherein the at least one terminal of the receptacle comprises a mounting portion, a mating portion extending from the mating portion, and an end portion extending from the mating portion and electrically contacting with the at least one shielding plate when the plug is coupled with the receptacle.

14. The electrical connector as claimed in claim 8, wherein the sidewall of the receptacle defines at least one cavity in communication with the at least one hole for receiving the at least one terminal of the receptacle.

15. An electrical connector comprising:

a plug comprising a housing, at least one terminal received in the housing, and at least one shielding plate; and a receptacle coupling with the plug, the receptacle comprising a housing and at least one terminal received in the housing, wherein when the plug and receptacle are coupled, the at least one terminal of the plug actuates the at least one terminal of the receptacle to extend through the housing of the receptacle and the housing of the plug and electrically contact the at least one shielding plate.

16. The electrical connector as claimed in claim 15, wherein at least two retention blocks are formed on a sidewall of the plug for securing the at least one shielding plate.

17. The electrical connector as claimed in claim 16, wherein the at least one shielding plate comprises a base portion secured between two corresponding retention blocks and the sidewall of the plug, and at least one retention portion extending from the base portion and secured between two corresponding retention blocks.

18. The electrical connector as claimed in claim 15, wherein the plug forms an insertion portion and defines at least one groove for receiving the at least one terminal of the plug, and a slot is defined in the receptacle for receiving the insertion portion of the plug.

19. The electrical connector as claimed in claim 15, wherein the at least one terminal of the receptacle comprises a mounting portion, a mating portion extending from the mating portion, and an end portion extending from the mating portion, and when the plug is coupled with the receptacle, the end portion rotates about the mounting portion to electrically contact the at least one shielding plate.

20. An electrical connector assembly comprising:

a first connector including a first insulative housing with a plurality of first contacts therein;

a second connector mateable with the first connector and including a second insulative housing with a plurality of resilient second contacts therein;

the second housing defining a plurality of holes in alignment with some of said second contacts, respectively;

at least one of said first connector and said second connector including an outer metal shell; wherein during mating, said some of the second contacts are outwardly deflected to respectively extend through the corresponding holes and electrically and mechanically engage said shell.

* * * * *